US007635253B2

(12) United States Patent
Garcia-Ortiz

(10) Patent No.: US 7,635,253 B2
(45) Date of Patent: Dec. 22, 2009

(54) DIGITAL PRESSURE CONTROLLER FOR PUMP ASSEMBLY

(75) Inventor: Asdrubal Garcia-Ortiz, Chesterfield, MO (US)

(73) Assignee: DRS Sustainment Systems, Inc., St. Louis, MO (US)

( * ) Notice: Subject to any disclaimer, the term of this patent is extended or adjusted under 35 U.S.C. 154(b) by 624 days.

(21) Appl. No.: 10/773,091

(22) Filed: Feb. 5, 2004

(65) Prior Publication Data

US 2004/0219025 A1 Nov. 4, 2004

Related U.S. Application Data

(60) Provisional application No. 60/445,290, filed on Feb. 5, 2003.

(51) Int. Cl.
*F04B 49/00* (2006.01)

(52) U.S. Cl. ..... 417/44.2

(58) Field of Classification Search ..... 417/44.1, 417/44.2, 42, 44.3
See application file for complete search history.

(56) References Cited

U.S. PATENT DOCUMENTS 4,021,700 A 5/1977 Ellis-Anwyl
4,575,313 A * 3/1986 Rao et al. ..... 417/26
4,686,439 A 8/1987 Cunningham et al.
5,313,548 A 5/1994 Arvidson et al.
5,888,051 A 3/1999 McLoughlin et al.
6,045,331 A 4/2000 Gehm et al.

FOREIGN PATENT DOCUMENTS

EP 0 652 374 A1 10/1994
WO WO 00/57063 9/2000

* cited by examiner

*Primary Examiner*—Michael Cuff
*Assistant Examiner*—Vikansha S Dwivedi
(74) *Attorney, Agent, or Firm*—Sonnenschein Nath & Rosenthal LLP

(57) ABSTRACT

A digital pressure controller that utilizes a microprocessor provides for control of the speed of a fluid pump engine for the purpose of maintaining specified pressures at both the inlet and outlet of the pump. Based upon pressure sensor output, and computations based on multiple calibrations between pump speed and pressure, and between output voltage and pump speed, a pump drive mechanism speed is determined by the control logic of the microprocessor, which speed maintains at least one of the inlet and outlet pressures within a specified range. The microprocessor may determine the specific weight of the fluid being pumped in order to select the pump drive mechanism speed.

2 Claims, 7 Drawing Sheets

DIGITAL PRESSURE CONTROLLER FOR PUMP ASSEMBLY

CROSS-REFERENCE TO RELATED APPLICATIONS

This application claims the benefit of U.S. Provisional Application No. 60/445,290, filed Feb. 5, 2003.

BACKGROUND OF THE INVENTION

1. Field of Invention

The invention relates to fluid pressure control via control over pump speed. More specifically, the invention embodies a pressure controller that controls pump speed based upon inlet and outlet fluid pressure, wherein pump speed is adjusted to maintain both inlet and outlet fluid pressures within specified ranges.

2. Description of Related Art

It is often desirable and most effective to use a pump to move fluids over a significant distance through a channel from one place to another. Pumps are common structures and appear in all sorts of configurations, can operate on all sorts of different principles, can pump all sorts of different fluids, and can pump those fluids over a wide range of distances and terrain. Generally some type of drive mechanism actuates the pump that moves the fluid.

The use of pumps may be the only practical way that fluid can be moved from one place to another over an intervening elevation. In particular, where the origin and destination of the fluid are separated either by terrain having multiple changes in elevation or by a sufficiently great distance, it may be necessary to utilize multiple pumps serially positioned along the fluid channel in order to maintain fluid flow, especially if flow is to be maintained at a relatively constant rate. Another situation in which the problem of unsteady fluid flow may best be solved using a series of pumps positioned at various intervals along the fluid channel is where the fluid source from which fluid arrives at the inlet of the first pump does not provide a steady fluid volume or fluid pressure. Such pumping of fluids over significant distances and varied terrain at a steady flow rate is often a desire in military applications. In particular, the military is primarily interested in transporting two different fluids, water, which is used to cook, clean, or drink, and petroleum based fuel, which is used to power vehicles and machines.

The above mentioned multiple pump, steady-flow solution suggests a pattern of sections of fluid channel in between serially displaced pumps. Such a pattern is often referred to as a "daisy chain." Such a daisy chain of pumps may consist of, for instance, a series of pumps for which each outlet is connected to a hose, the opposite end of which connects to the inlet of another pump, except that the outlet of the last pump in the series is not further connected to another pump, but discharges the pumped fluid to a desired location. For such a daisy chain of pumps to operate properly, each pump must maintain a certain level of flow through the segment of pipe into which it pumps fluid so that the flow reaching the next pump is sufficient for that next pump to maintain the flow in the channel section that follows it, and so on.

In at least one application of such daisy chain, the daisy chain can be designed (particularly through the specification of the horizontal distance between pumps) such that identical pumps can be driven at identical speeds to produce identical inlet and outlet pressures at each pump, and a constant flow rate from the first pump to the last. Such a situation is highly idealized, but is the situation often desired by the military, which operates under conditions that necessitate standardization.

The U.S. military has, in fact, provided a performance specification and a test procedure for a pump that may be used in just such a daisy chain. The specification, MIL-PRF-53051, is entitled "Performance Specification: Pumping Assemblies, Wheel-Mounted, Diesel Engine Driven, Bulk Transfer, Fuel and Potable Water Pumping Service," Rev. B (Aug. 6, 1998). The test procedure, MKP-1398-ATP, is entitled "350 gpm Pump Acceptance Test Procedure," Rev. E (Jan. 17, 2001). Both of these documents, MIL-PRF-53051 and MKP1398ATP, are herein incorporated in their entirety by specific reference.

Considering now an individual pump having an inlet and outlet for fluid, where the inlet and outlet are connected to a fluid flow channel that is part of a larger fluid flow system (e.g., a daisy chain), if all other variables within the fluid flow system that impact inlet and outlet pressure ("fluid flow system parameters") remain constant, the speed at which the pump is driven will be directly related to outlet pressure and inversely related to inlet pressure. That is, with all other variables constant, as the speed of the pump increases, the fluid pressure at the outlet increases and the fluid pressure at the inlet decreases. The exact nature of these relationships (e.g., whether first order, second order, exponential, or other) depends on the characteristics of the pump and the fluid flow system parameters.

From the existence of these separate relationships of the inlet and outlet pressures to the pump speed, it becomes evident that the pump speed can be made an independent variable used to adjust the inlet and outlet pressures. Where the fluid flow system parameters permit, pump speed can be used to maintain the inlet and outlet pressures within a separately prescribed range. That is, adjustment of the pump speed can keep the inlet pressure and the outlet pressure from dropping below an individually set minimum value and from raising above an individually set maximum value. The ability to control inlet and outlet pressures through adjustments in pump speed is maintained so long as the configuration of the fluid flow system has not caused excessive pressures to build up at either the inlet or the outlet, and so long as sufficient fluid is provided to the inlet such that a minimum pressure is there maintained.

Examples of how pump speed can be used to control inlet and outlet pressures follow. Where the outlet pressure is measured to be above a preferred maximum value (the maximum outlet pressure limit), the pump speed can be reduced so that the outlet pressure is consequently reduced. As another example, where the inlet pressure is measured to be above a preferred maximum value (the maximum inlet pressure limit), the pump speed can be increased so that the inlet pressure is consequently reduced.

A limitation to pressure control through pump speed is provided by the minimum and maximum speed of the pump drive mechanism. Where the drive mechanism is an internal combustion engine, the minimum speed will be provided by the idle speed of the engine. The maximum speed of such an engine is a function of engine design, and will likely be specified by the engine manufacturer as a safe maximum continuous operating speed.

Besides the relationship wherein the inlet and outlet pressures vary according to the pump speed, there is, at any given pump speed (as long as there is sufficient flow in the fluid flow system), a direct relationship between the inlet pressure and the outlet pressure. That is, at a given pump speed, as the inlet pressure increases, the outlet pressure also increases, and as the inlet pressure decreases, the outlet pressure also decreases. Because the action of the pump is directional (in the direction of fluid flow) the reverse of this relationship is not true; while outlet pressure is dependent upon inlet pressure, inlet pressure is not dependent upon outlet pressure.

Because the inlet and outlet pressures may be independently affected by the fluid flow system parameters, and are not solely affected by the pump speed, it is necessary in order to allow rational control over inlet and outlet pressure through pump speed that the fluid flow system is carefully designed not to generate conditions outside the acceptable ranges when the pump is operating normally. If the fluid flow system is not so designed a situation could arise where the measured output pressure was above the maximum outlet pressure limit, indicating a need to decrease pump speed, and the measured inlet pressure was above the maximum inlet pressure limit, indicating a need to increase pump speed. Such a condition is not amenable to rational control that maintains both inlet and outlet pressures within specified ranges.

Another variable that will affect the inlet and outlet pressure is the particular fluid being pumped. With all other fluid flow system parameters constant, the difference between the inlet and outlet pressure will be greater for a fluid of higher specific weight. So, for any given pump speed and inlet pressure, the outlet pressure will be higher when a fluid of relatively high specific weight is being pumped than will be the outlet pressure when a fluid of comparatively lower specific weight is being pumped. Thus, a pump speed calibration correlating inlet and outlet pressures with particular pump speeds will necessarily be different for fluids of varying specific weight.

Existing pressure controllers for maintaining inlet and outlet fluid pressures at a pump have used analog electrical circuitry incorporating PID (proportional-integral-derivative) control in a feedback loop. A disadvantage of analog control, generally, is a lack of precision. A disadvantage of PID control, generally, is the complex circuitry required. For a pump designed to pump multiple fluids, a particularly significant disadvantage to analog-PID pressure control is its inability to easily control pressures for multiple fluids because each fluid may require the implementation of unique pressure limits and certainly will require the utilization of different pump speed calibration curves. Specifically, under conditions where the pump drive mechanism normal operating speed is specified, because of the varying relationship between inlet and outlet pressure among fluids of varying specific weight, the specified pressure limits for two such fluids must be different. A possible but inconvenient way to provide stable analog-PID pressure control for multiple fluids is to provide separate circuits correlated with each fluid potentially pumped. Generally, for existing systems of multiple analog-PID circuits, the proper circuit for a given application must be manually selected.

SUMMARY OF THE INVENTION

Embodiments of the present invention utilize programmable digital pressure control to enable automatic, stable pressure control over the pumping of a variety of fluids under a variety of conditions, without the need for user input as fluids and conditions change. Control is provided based on a control logic that utilizes known relationships between pump speed and fluid pressures and adjusts pump speed based on those relationships. Advantages of these embodiments may include a high degree of precision and reliability with a relatively low degree of complexity, as well as relatively simple adaptability to multiple application environments, including the ability to pump multiple fluids under controlled pressure conditions without the need for user input. Additionally, the use of a digital microprocessor in the pressure controller allows for enhancing features to be included with the pressure controller, including capability for pump maintenance analysis and fluid flow system analysis. Such enhancing features may be particularly useful where the pressure controller is used on a pump that is part of a daisy chain.

An embodiment of the invention is a fluid pump having an inlet and an outlet through which a fluid can pass; a pump drive mechanism arranged to drive the pump at a selected speed; a pressure transducer capable of measuring a pressure value of the fluid passing through at least one of the inlet and the outlet of the pump and produce an electrical signal correlated to the pressure value; and a microprocessor having a control logic program and being capable of receiving as input the electrical signal correlated to the pressure value; wherein, the microprocessor produces an output electrical signal used by the pump drive mechanism to drive the pump at the selected speed based on the control logic program. The fluid pump may include another pressure transducer so that a pressure value of the fluid passing through both the inlet and outlet of the pump may be measured. The pump may also include a mode selector switch that engages various electrical circuits depending upon the position of the switch to select a mode of operation of the pump, which mode may be a start mode, a manual mode, and an automatic mode. The pump may also include a potentiometer that provides manually adjustable inlet and outlet pressure control in the manual mode.

The microprocessor uses at least one of a first known mathematical relationship between the speed of the pump drive mechanism and the inlet pressure at the pump, and a second known mathematical relationship between the speed of the pump drive mechanism and the outlet pressure at the pump to compute a pump drive mechanism speed that would theoretically maintain at least one of the inlet and outlet pressures at about the value at which the inlet and outlet pressures were measured via the electrical signal correlated to the actual pressure value. The microprocessor may also compute the specific weight of the fluid being pumped from measured values of inlet and outlet pressures during pumping, and use the computed specific weight to select the first and second known mathematical relationships.

The output electrical signal from the microprocessor is a voltage that is calculated by the microprocessor according to calibration data relating a pressure controller output signal to a pump drive mechanism speed. The microprocessor compares the electrical signal to at least one pressure limit and computes at least one of a target inlet drive mechanism speed and target outlet drive mechanism speed that depend on whether the measured pressure reading is greater than or less than the pressure limit. The microprocessor uses a mathematical relationship between the speed of the pump drive mechanism and a voltage level of the output electrical signal to select an output electrical signal that corresponds to the target pump drive mechanism speed. The selected output electrical signal may be determined in a manner to correlate with a pump drive mechanism speed that is the lesser of a target outlet speed and a target inlet speed. The target inlet speed may be a maximum drive mechanism speed if the measured inlet pressure is greater than or equal to a maximum inlet pressure range value; or may be the greater of a minimum drive mechanism speed and a speed calculated to maintain the measured inlet pressure, if the measured inlet pressure is less than a maximum inlet pressure range value. The target outlet speed may be a maximum drive mechanism speed if the measured outlet pressure is less than or equal to a minimum outlet pressure range value; or the target outlet speed may be the lesser of a minimum drive mechanism speed and a speed calculated to maintain the measured outlet pressure, if the measured outlet pressure is greater than a minimum outlet pressure range value.

An embodiment of the invention is a method of controlling fluid pressure in at least one of a pump inlet and pump outlet, wherein the method includes providing a digital pressure controller, reading a measured value of at least one of an inlet and outlet pressure at a pump, comparing at least one of the measured values of inlet and outlet pressure to at least one of a minimum and maximum pressure limit, computing at least one of a target inlet drive mechanism speed and a target outlet drive mechanism speed based on whether at least one of the measured inlet and outlet pressure readings are greater than or less than the at least one of a minimum and maximum pressure limit, setting an output electrical signal from the digital pressure controller to a value that corresponds with at least one of the target drive mechanism speeds computed in the step of computing, and controlling fluid pressure by adjusting pump drive mechanism speed according to the output voltage signal of the pressure controller. A method also include selecting the lesser of a target inlet drive mechanism speed and a target outlet drive mechanism speed, and setting an output electrical signal from the digital pressure controller to a value that corresponds with the target drive mechanism speed selected in the step of selecting.

A further embodiment of the invention is a digital pressure controller for use with a pump having an inlet and an outlet through which a fluid can pass and which can be driven at a selected speed by a pump drive mechanism, the digital pressure controller including a microprocessor having a control logic program and being capable of receiving as input an electrical signal correlated to the pressure value, the electrical signal being generated by a pressure transducer capable of measuring a pressure value of the fluid passing through at least one of the inlet and the outlet of the pump to correlate to the pressure value; wherein the microprocessor produces an output electrical signal used by the pump drive mechanism to drive the pump at the selected speed based on the control logic program. Such a digital pressure controller may include a microprocessor that computes the specific weight of the fluid being pumped from measured values of inlet and outlet pressures during pumping, and uses the computed specific weight to select the first and second known mathematical relationships to compute a pump drive mechanism speed.

DETAILED DESCRIPTION OF PREFERRED EMBODIMENTS

Described herein are embodiments of a pressure controller that connects to the drive mechanism of a fluid pump and allows the inlet and outlet fluid pressures at the pump to be appropriately controlled according to an external standard. The pressure controller adjusts the speed of the pump drive mechanism based upon pressure values measured at the inlet and outlet of the fluid pump to produce a drive mechanism speed that brings about inlet and outlet pressures either within a prescribed range of values or above or below a limit value. In an embodiment, the pressure controller is designed to allow appropriate pressure control for various fluids of differing specific weight. When the controller is provided with data correlating the fluid being pumped (or the fluid's specific weight) to inlet and outlet pressures at various pump speeds, it adjusts pump speed to maintain inlet and outlet pressures above or below specified limit values.

Figure 1:
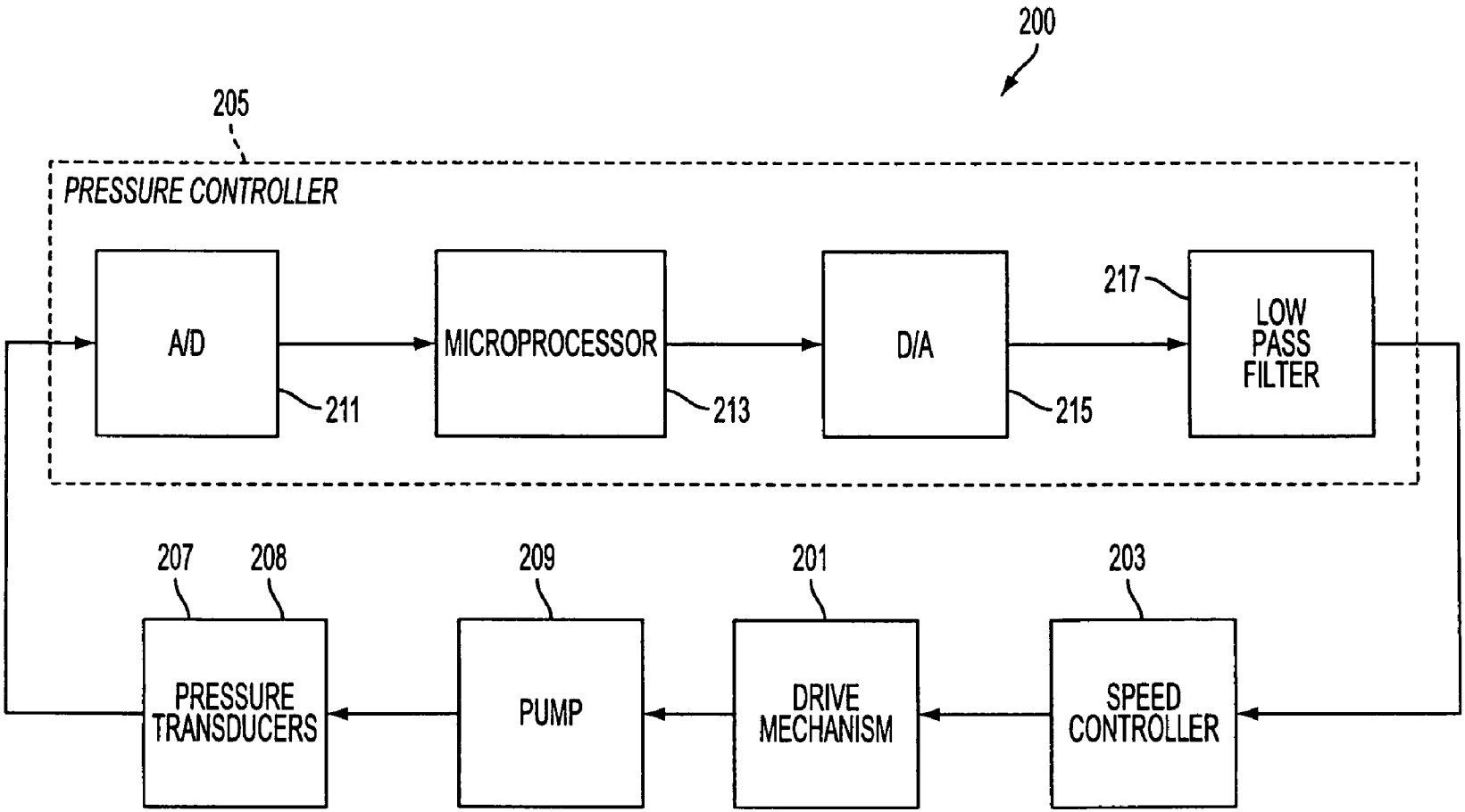
FIG. 1 shows a block diagram of the components of an entire pump system, including the components of a pressure controller that embodies the invention.

FIG. 1 shows a block diagram of the basic components of an entire pump system (200), including the basic components of a pressure controller (205) for automatic control of the inlet and outlet pressures of the pump (209). The pump system (200) is powered by a drive mechanism (201). The drive mechanism in the embodiments described in this Detailed Description section generally will be an internal combustion engine, however, other drive mechanisms, such as electric motors, may also be used in conjunction with a pressure controller that embodies the present invention. In embodiments in which the drive mechanism is not an internal combustion engine, some of the components or functions of the pressure controller (205) herein described would not be necessary. Components and functions described herein that are specific to the coupling of the pressure controller (205) to an internal combustion engine are known and understood by one of ordinary skill in the art.

Continuing with a description of FIG. 1, the speed (e.g. measured in revolutions per minute, RPM) of the drive mechanism (201) is adjusted by the speed controller (203), which in turn is controlled by the pressure controller (205). The pressure controller (205) exerts control through an output voltage signal that results from the processing of variable voltage input signals from a pair of pressure transducers (207 and 208) that measure fluid pressure at the inlet and outlet of the pump (209).

Within the pressure controller (205) the analog voltage signal from the pressure transducers (207 and 208) is first converted to a digital signal via an analog-to-digital (A/D) converter (211). The digital signal passes into the microprocessor (213) where preprogrammed control logic is used to process the input voltage, generating an output voltage according to the control logic. The digital output signal from the microprocessor is then converted via a digital-to-analog (D/A) converter (215) to an analog signal that is sent to the speed controller (203). The analog voltage output signal from the pressure controller (205) is the signal used by the speed controller (203) to adjust the speed of the drive mechanism (201). Where the drive mechanism (201) is an internal combustion engine, the pressure controller (205) output signal is the signal used by the speed controller (203) to adjust the throttle of the engine.

Figure 5:
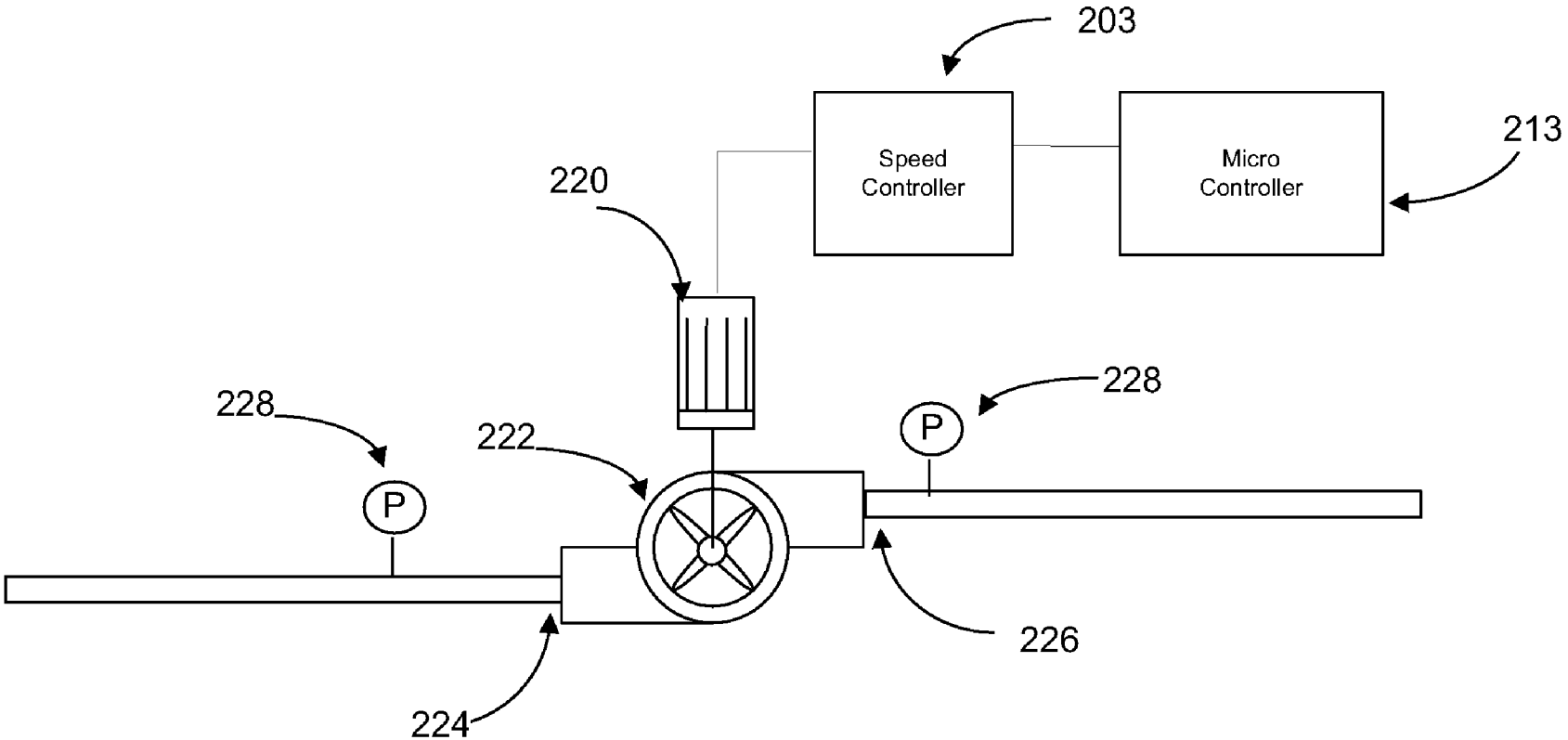
FIG. 5 shows a schematic diagram of a pumping system consistent with an embodiment of the present invention.

FIG. 5 shows a schematic diagram of a pumping system consistent with an embodiment of the present invention. A pump 222 consists of an inlet 224, an outlet 226, and a motor 220. The motor 220 is electrically coupled to the speed controller 203 which controls the speed of the motor 220 which in turn controls the speed of the pump 222. A microcontroller 213 is electrically coupled to at least one pressure transducer 228 which is/are located on the pump outlet 226 and/or the pump inlet 224. The microcontroller 213 is configured to receive electrical signals from the pressure transducer 228 (which may or may not have two pressure sensing locations, as illustrated) and adjust the speed of the pump 222 via the speed controller 203, as described herein.

Figure 2A:
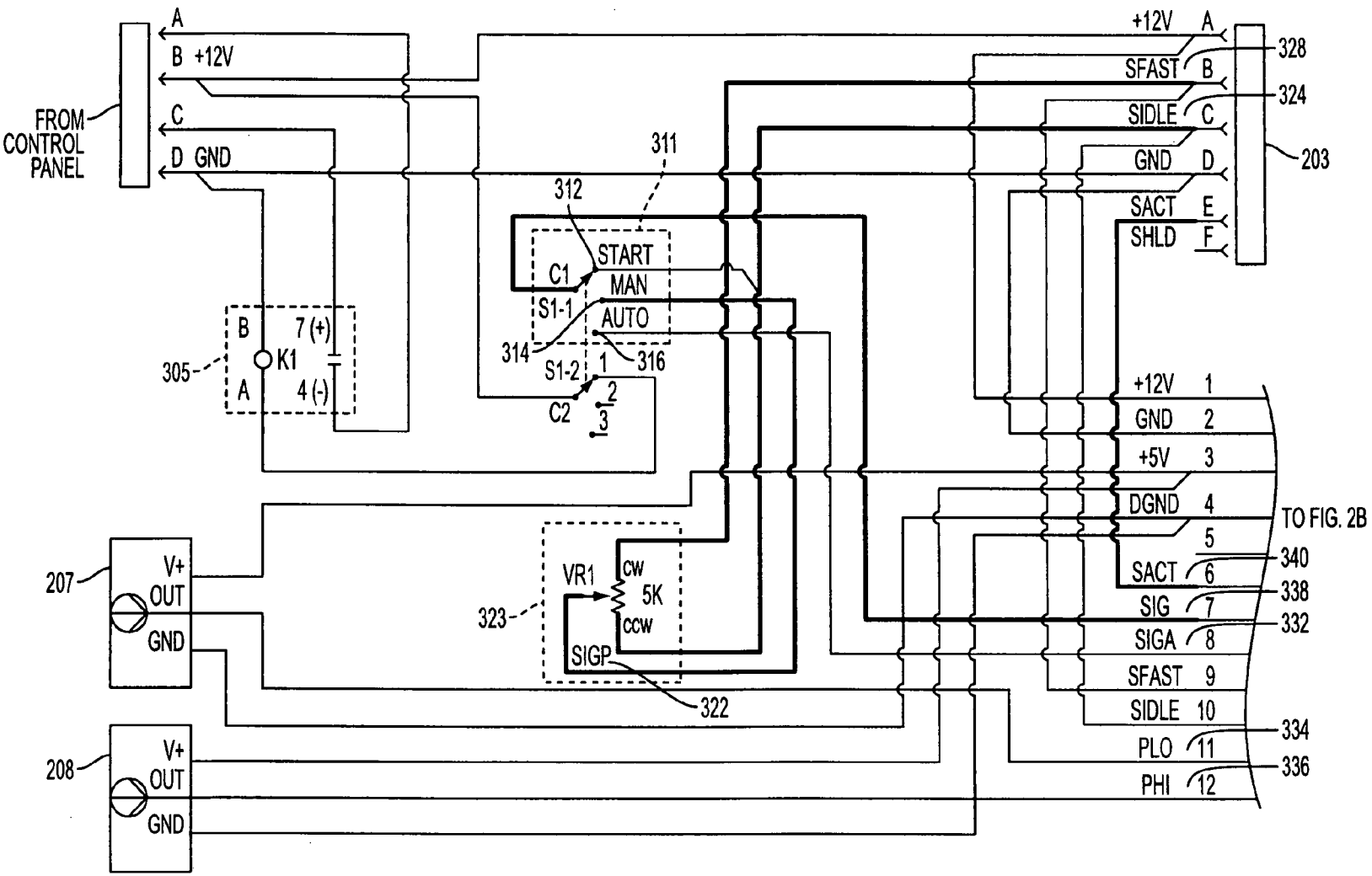
FIG. 2A shows a portion of the circuitry of a pressure controller.
Figure 2B:
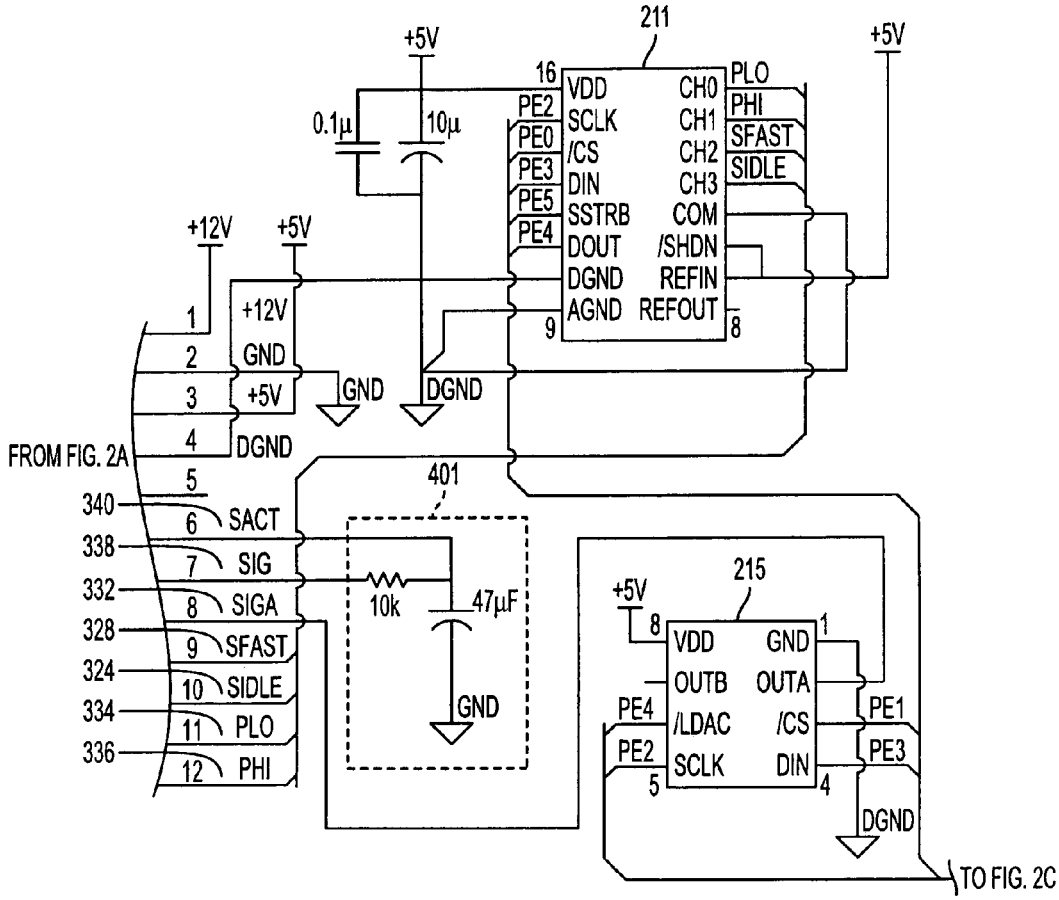
FIG. 2B shows another portion of the circuitry of a pressure controller.
Figure 2C:
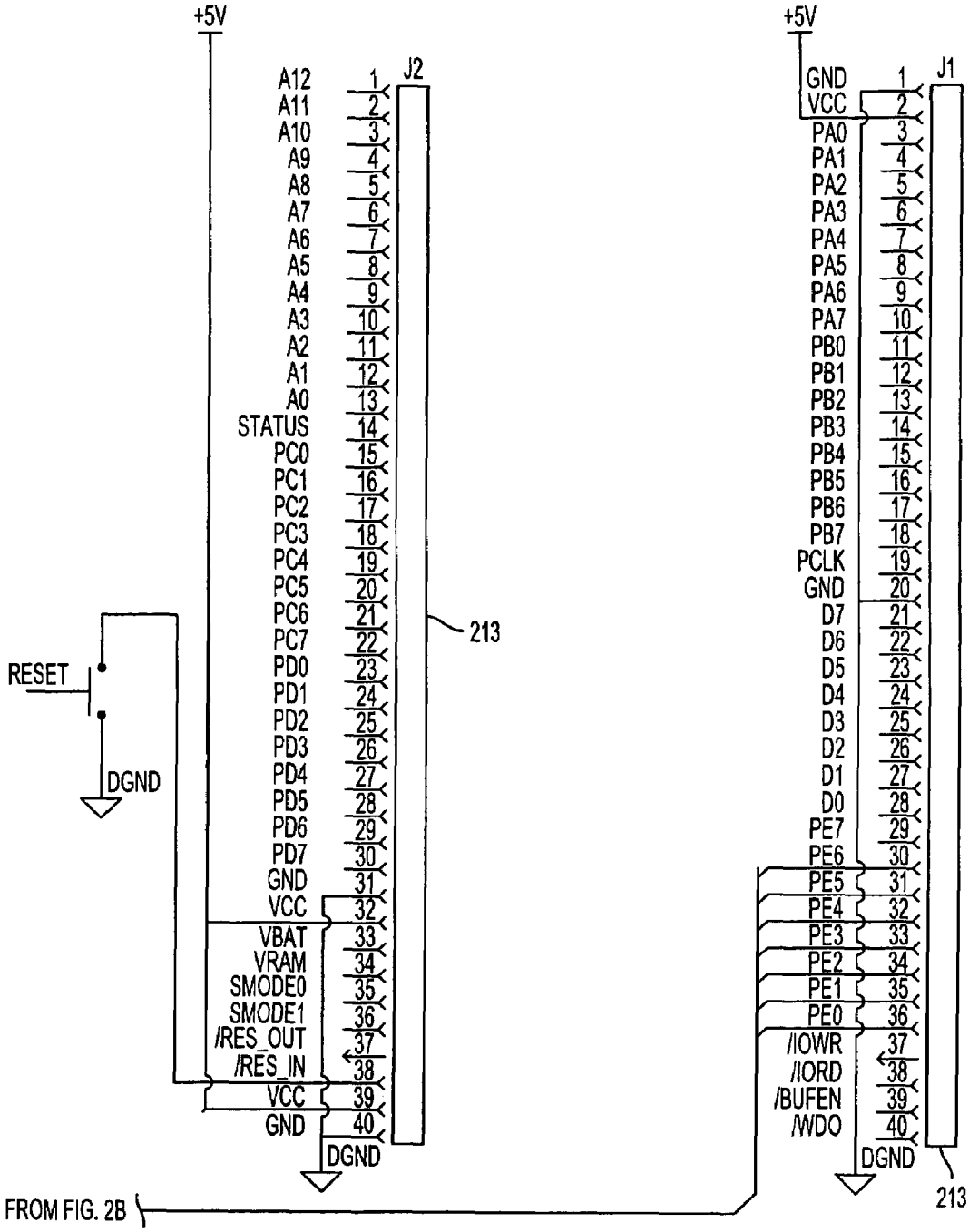
FIG. 2C shows another portion of the circuitry of a pressure controller.
Figure 3:
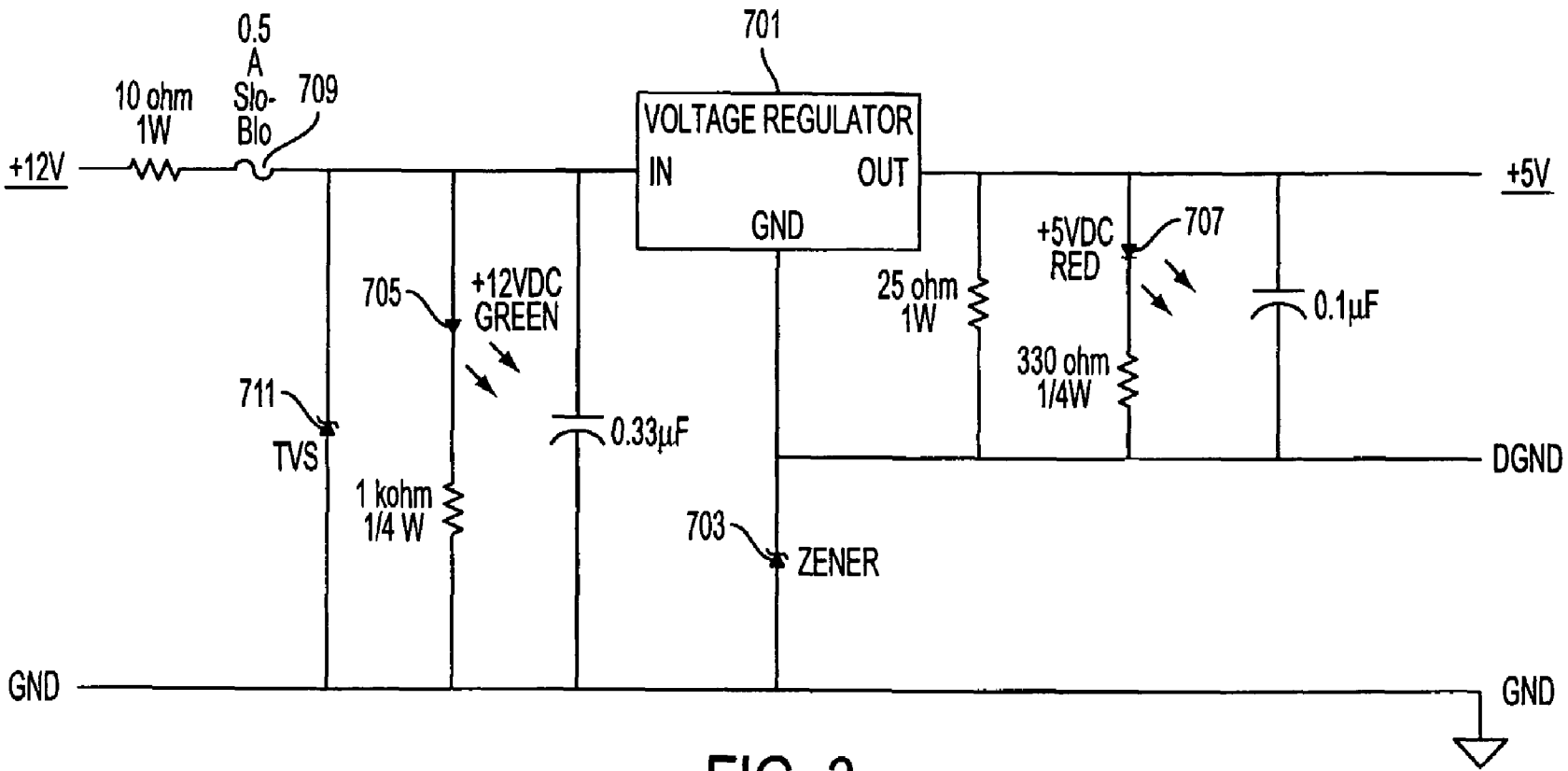
FIG. 3 shows an embodiment of a power supply circuit for a pressure controller.

FIG. 3 shows an embodiment of a power supply circuit for the pressure controller (205). A linear voltage regulator (701) is used to generate 5VDC out of the 12VDC available from the pump system (200) power supply (not shown). The ground of the regulator is biased +3.3VDC by means of a zener diode (703). This allows the D/A converter (215) (FIG. 1) to produce voltage levels in the 3.3VDC to 8.3VDC range relative to GND. All the digital components of the pressure controller (205) (FIG. 1) and the pressure transducers (207 and 208) (FIG. 1) are connected between +5V and DGND (See also FIG. 2). Two light emitting diodes (705 and 707) are preferably used to provide visual verification of power availability. The circuit is protected against a short by a fuse (709), and from transients by a TVS (711).

FIGS. 2A-C show the electric circuitry connecting various components of a pump system (200) (FIG. 1) to a pressure controller (205). Note that FIGS. 2A-C may be referred to collectively as FIG. 2, and as between FIGS. 1 and 2, elements with similar function will be similarly numbered.

Shown in FIG. 2 is an embodiment of a pressure controller (205) (FIG. 1) that is designed for use with a pump system (200) (FIG. 1) that meets MKP-1398-ATP, as described in the Background section. The embodiment of FIG. 2 provides a user interface at two components: a mode switch (311) and a potentiometer (323). The mode switch (311) is designed to allow the pump system (200) to operate in three modes corresponding to the three positions of the mode switch (311): start mode position (312), manual mode position (314), and automatic mode position (316). For the embodiment shown in FIG. 2, only in the automatic mode position (316) does a microprocessor (213) (FIG. 1) act on the input voltage signal to control the speed controller (203). FIG. 2A shows the primary pressure controller components and circuitry for the start and manual mode positions (312 and 314), which will be discussed first, and only a portion of the components and circuitry used in the automatic mode position (316), which will be discussed later in conjunction with FIGS. 2B-C.

The start mode position (312) is used to start the drive mechanism (201) (FIG. 1) and is not normally utilized during continuous operation of the pump. When the mode switch (311) is positioned to the start mode position (312), the majority of components and connections of the pressure controller (205) (FIG. 1) are not part of the electrical circuit. Rather, when the mode switch (311) is in the start mode position (312), the relay (305) is energized, allowing current to flow in the starter (not shown) of the drive mechanism (201) (FIG. 2), thus allowing the drive mechanism (201) (FIG. 2) to be started. Additionally, in the start mode position (312), the voltage level SIDLE (324) provided by the speed controller (203), passes through the mode switch (311) to become SIG (338), which is passed through a low pass filter (217) to produce the signal, SACT (340), that is sent to the speed controller (203). SIDLE (324) is the low voltage level output by the speed controller (203) and corresponds with the slowest speed to which the speed controller (203) can adjust the drive mechanism (201). By passing the SIDLE signal (324) to the speed controller (203) during start-up, the drive mechanism is started, and continues to run while in the start mode position (311), at a minimum speed. Passing the SIDLE signal (324) to the speed controller through the low pass filter (217) ensures a smooth transition to the speed commanded by the pressure controller when the mode switch (311) is switched to either the manual or automatic mode positions (314 or 316).

After the drive mechanism is started, the mode switch may be positioned to either the manual mode position (314) or the automatic mode position (316). In the manual mode position (314) the speed of the drive mechanism is adjusted according to the output of the potentiometer (323), which is adjusted manually. The potentiometer (323) produces a manually variable voltage signal, SIGP (322), that is fed to the speed controller (203) to set the speed of the drive mechanism (201) (FIG. 2). The voltage range of SIGP (322) is defined by the two voltage levels, SIDLE (324) and SFAST (328), output from the speed controller (203) and fed to the potentiometer (323). As mentioned above SIDLE (324) corresponds with the slowest speed to which the speed controller (203) can adjust the drive mechanism (201). SFAST (328) corresponds with the fastest speed to which the speed controller (203) can adjust the drive mechanism (201). Thus, as the two voltage levels provided by the speed controller (203) define the range of the potentiometer (323) output, they also define the minimum and maximum speed of the drive mechanism (201) (FIG. 2) when the pressure controller is in the manual mode position (314). The two voltage levels shown in the embodiment of FIG. 2 as SIDLE (324) and SFAST (328) may be any voltage levels output from a speed controller (203) actually used in an embodiment of the pump system (200) of FIG. 2.

To complete the discussion of the operation of the pressure controller (205) in the manual mode position (314) requires reference to FIG. 2B. The majority of the components and connections shown in FIG. 2B are used only in the automatic mode position (316). The low pass filter (217), however, is used in the manual mode position (314), as well as the start and automatic mode positions (312 and 316). In the manual mode position (314) the signal from the potentiometer (323), SIGP (322), passes through a low pass filter (217) prior to exiting the pressure controller (205) on the way to the speed controller (203). After passing through the low pass filter (217), SIGP (322) becomes SACT (340), the signal sent to the speed controller (203). The time constant of the low pass filter (217) should be large enough to ensure that the drive mechanism (201) does not enter into an oscillatory or other unstable condition.

Again considering FIG. 2A, the automatic mode position (316) is the last of the three possible modes of operation of the pressure controller (205) there shown. In conjunction with FIGS. 2B-C, it can be seen that in the automatic mode position (316) the basis for the output of the pressure controller (205) is a signal generated by the microprocessor (213) (FIG. 2C). The microprocessor (213) produces a voltage signal, SIGA (332), that results from the processing by the microprocessor of the output voltage signals, PLO (334) and PHI (336), produced by the pressure transducers (207 and 208). FIG. 2A shows the pressure transducer output voltage signals, PLO (334) and PHI (336), entering the pressure controller (205). In FIG. 2B these output voltage signals, PLO (334) and PHI (336), are shown entering the A/D converter (211). The output of the A/D converter (211) passes to the microprocessor (213) (FIG. 2C). After a digital input signal from the A/D converter (211) is processed in the microprocessor (213), a consequent signal passes out of the microprocessor (213) and enters the D/A converter (215). The output of the D/A converter (215) is SIGA (332). Through this digital processing, discussed in more detail below, SIGA (332) is dependent upon the pressure levels at the inlet and outlet of the pump (209) (FIG. 1). Tracing the path of SIGA (332), requires review of FIGS. 2A-B. SIGA (332) passes out of the D/A converter (215) (FIG. 2B) and through the mode switch (311) (FIG. 2A) to become SIG (338). SIG (338) is passed through a low pass filter (217) (FIG. 2B), as was SIGP (322), to produce the signal, SACT (340), that is sent to the speed controller (203).

In alternate embodiments of the pressure controller, either or both of the mode switch (311) and the potentiometer (323) could be separate components of the pump system (200) rather than being integral to the pressure controller (205), or could be absent altogether from the pump system (200). In an embodiment where both the mode switch (311) and potentiometer (323) are separate components of a pump system (200), the pressure controller (205) is engaged only in the automatic mode position (316). In a further alternate embodiment the potentiometer (323) voltage signal, SIGP (322), could be sampled by the A/D converter (213), further processed by the microprocessor (213), and converted back to an analog signal in the D/A converter (215) prior to being output from the pressure controller (205) to the speed controller (203). An advantage of feeding the potentiometer (323) voltage signal, SIGP (322), directly to the speed controller (203), as shown in FIGS. 2A-B, is that in the manual mode position (314) the pressure controller (205) still operates properly even when the digital components (e.g., the microprocessor (213)) fail. Additionally, while the A/D and D/A converters (211 and 215) are shown as separate components from the microprocessor (213), in an alternate embodiment the A/D and D/A converters (211 and 215) may be integral to the microprocessor (213).

When the embodiment of the pressure controller (205) shown in FIGS. 2A-C is operating in the automatic mode position (316), the output of the pressure controller (205) is a signal, SACT (340), that results from the processing of the pressure controller (205) inputs, PLO (334) and PHI (336). The processing occurs primarily in the microprocessor (213), and is a result of the action of the control logic presented in FIG. 4 in the form of a flowchart.

Figure 4:
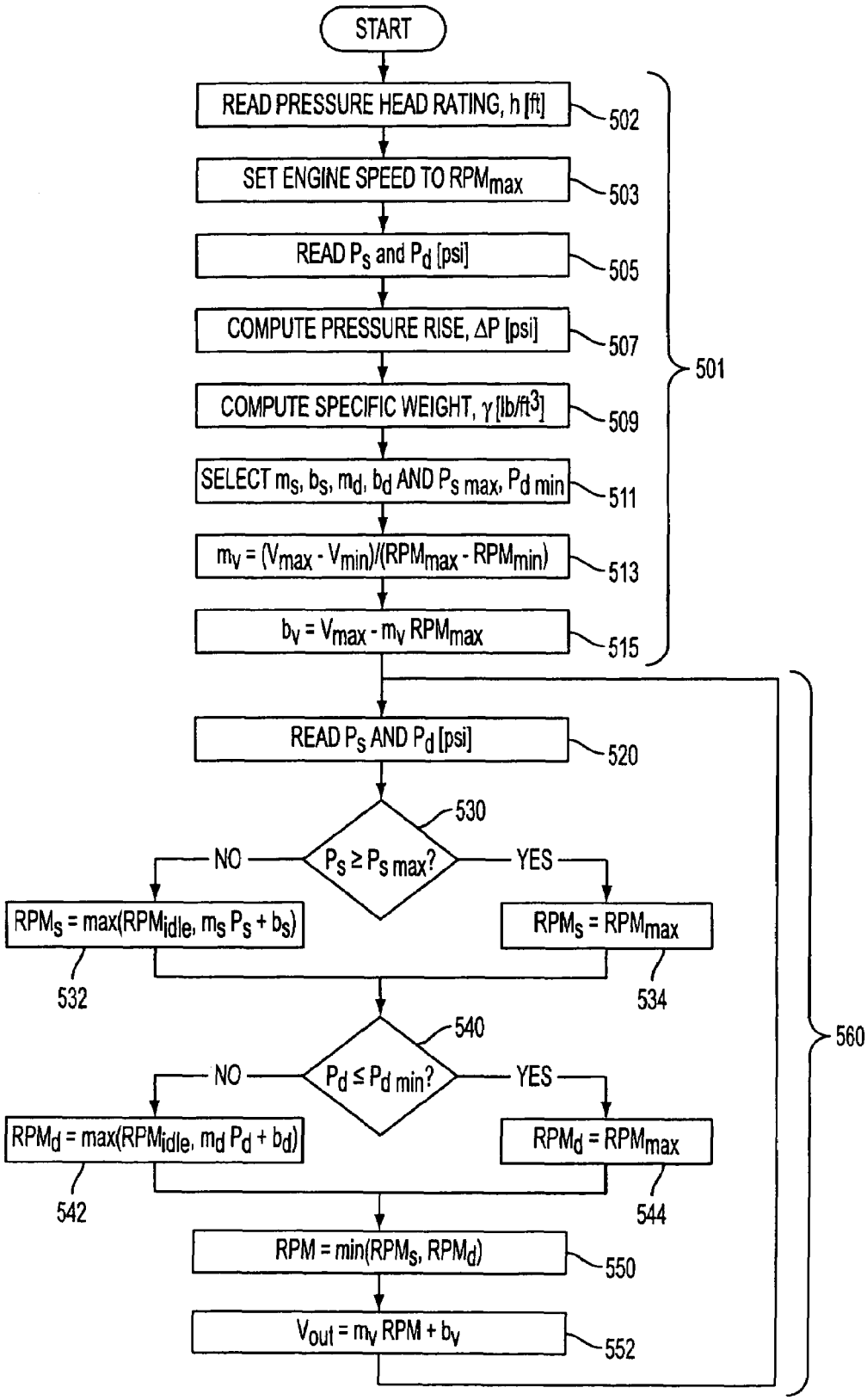
FIG. 4 shows in a flowchart an embodiment of the control logic for a digital pressure controller.

Looking at the flowchart of FIG. 4, the first series of steps, the initialization steps (501), are an initialization sequence that is carried out when the mode switch (311) (FIG. 2A) is switched to the automatic mode position (316) (FIG. 2A). The initialization steps (501) include steps that provide the data needed by the microprocessor (213) (FIG. 1) to perform the computations and comparisons of the operating steps (560). The next series of steps, the operating steps (560), process the input signals, PLO (334) and PHI (336), and produce the microprocessor output signal that after passing through the D/A converter (215) becomes SIGA (332) (FIG. 2B). Discussion of the steps of the control logic will make frequent reference to the electrical signals shown in FIGS. 2A-C, and the components of the pump system (200) shown in FIG. 1, all of which have been discussed above, and which will not be specifically referenced in the following discussion to one of these FIGS. 1-2.

During the initialization steps (501), the control logic uses several data points that must be input externally or stored in a memory device (not shown) that is accessible by the microprocessor (213). For example, in step (502) the pressure head rating of the pump is read. The microprocessor can obtain this data point either from an external source, such as user input, or may obtain it from a memory device to which the microprocessor has access. The pressure head rating is stored by the microprocessor for later use in the computation of the specific weight of the fluid being pumped. Also, step (511) selects values for the slope and intercept of two calibration curves, and values for the pressure limits at the inlet and outlet. One curve for which the slope and intercept are selected is a line that relates the speed of the drive mechanism (201) to the fluid pressure at the inlet of the pump (209) based on the specific weight of the fluid being pumped. The other slope and intercept data selected relates the speed of the drive mechanism (201) to the fluid pressure at the outlet of the pump (209) based on the specific weight of the fluid being pumped. Additionally in step (511), the minimum outlet pressure limit and the maximum inlet pressure limit are read by the microprocessor (213). These pressure limits may vary depending on the specific weight of the fluid being pumped. Appropriate values for the slopes and intercepts, and for the pressure limits are either input by a user, or are programmed into electronic memory accessible to the microprocessor (213).

Continuing with a description of the initialization steps (501) of the control logic, step (503) sets the output of the pressure controller (205) to a voltage signal that corresponds to the maximum speed allowed by the speed controller (203), by generating an output signal, SIGA (332), that is equal to the maximum voltage in the range provided by the speed controller (203) (SFAST (328) in the example above). After so setting the drive mechanism speed, the pressure values at the pump inlet and pump outlet corresponding to maximum drive mechanism speed are determined in step (505) based on a reading of PLO (334) and PHI (336). Note that to determine the pressure values in units of force per unit area the microprocessor should also have access to calibration data for the pressure transducers (207 and 208) that relates the voltage signals PLO (334) and PHI (336) to the actual pressure readings in force per unit area. The change in pressure between the inlet and outlet is computed in step (507). Step (509) computes the specific weight of the fluid being pumped according to the equation, well known to one of ordinary skill in the art, $\Delta P=\gamma*h$, where $\Delta P$ is the change in pressure, $\gamma$ is the specific weight of the fluid, and h is the pressure head rating of the pump (209).

Having computed the specific weight of the fluid being pumped, the appropriate curves (including slope and intercept data) for drive mechanism speed versus pressure can be read from user input or memory in step (511), since selection of the proper curves is dependent upon the fluid's specific weight. As noted in the Background, the relationship between drive mechanism speed and pressure varies for fluids of different specific weight. Also read in step (511) are values for the maximum inlet pressure limit and minimum outlet pressure limit, which also can be read from user input or memory, and which also may vary depending on the fluid's specific weight.

The final two steps (513 and 515) of the initialization steps (501) in the embodiment of the control logic shown in FIG. 4 establish a linear relationship between the voltage range of the speed controller and the speed range of the drive mechanism (201). This linear relationship will be used in step (552) of the operating steps (560) to determine the microprocessor (213) output voltage signal that will become SIGA (332).

Once the initialization steps (501) have been performed, the microprocessor has all of the data required for the comparisons and computations performed in the operating steps (560). The only required data remaining outstanding are the measured inlet and outlet pressures as read regularly by the microprocessor (213) from the pressure transducers (207 and 208). Thus, in step (520) the microprocessor reads the pressure transducer output voltage signals, PLO (334) and PHI (336), which are converted to actual pressure readings.

In step (530) the inlet pressure is compared to the maximum inlet pressure limit as set by an external standard. If the measured inlet pressure is greater than or equal to the maximum inlet pressure limit, step (534) sets a value for the target inlet drive mechanism speed ("inlet speed"), $RPM_S$, that is equal to the maximum drive mechanism speed, $RPM_{max}$. The target "inlet speed" of $RPM_{max}$, which is the maximum speed to which the speed controller (203) can set the drive mechanism, if selected as the drive mechanism speed after the remainder of the processing steps would allow for a reduction in the inlet pressure, assuming the pump speed at the time of the reading of the inlet pressure is less than this maximum speed.

If, on the other hand, the comparison of measured inlet pressure to the maximum inlet pressure limit in step (530) shows that the measured inlet pressure is less than the maximum inlet pressure limit, the microprocessor (213) does a further comparison and selection in step (532), selecting the larger speed value between the minimum drive mechanism speed, $RPM_{idle}$, and the speed computed using the slope and intercept values selected in step (511). The speed computed using the slope and intercept values selected in step (511) is the speed that theoretically would maintain the inlet pressure at the measured inlet pressure value according to the calibration of drive mechanism speed to inlet pressure for a fluid having a specific weight of the fluid being pumped. The value selected by the microprocessor (213) for the "inlet speed" according to either step (532) or step (534) is stored by the microprocessor (213) for later use in the comparison made in step (550).

After selecting the target "inlet speed," the microprocessor determines the target "outlet speed," $RPM_d$. First, in step (540), the microprocessor (213) compares the measured outlet pressure to the minimum outlet pressure limit as set by the external standard. If the measured outlet pressure is less than or equal to the minimum outlet pressure limit, the microprocessor sets the target "outlet speed" to the maximum drive mechanism speed, $RPM_{max}$, in step (544). By setting the pump speed to $RPM_{max}$, if this were to become the final microprocessor control after the microprocessor finished processing, the outlet pressure would be increased, hopefully to a value above the minimum output pressure limit.

If, on the other hand, the measured outlet pressure is greater than the minimum outlet pressure limit, the microprocessor performs a further comparison and selection in step (542) setting the target "outlet speed" to the greater of the values as between the minimum drive mechanism speed, $RPM_{idle}$, and the speed computed from the slope and intercept values selected in step (511). Again, the speed computed from the slope and intercept values selected in step (511) is the speed that would theoretically maintain the outlet pressure at the measured outlet pressure value according to the calibration of drive mechanism speed to outlet pressure for a fluid having a specific weight of the fluid being pumped. The value selected by the microprocessor (213) for the "outlet speed" according to either step (542) or (544) is stored by the microprocessor (213) for later use in the comparison of step (550).

In the final two steps of the operating steps (560) in the embodiment shown in FIG. 4, the microprocessor selects the desired drive mechanism speed and determines the output voltage that corresponds to this desired speed. First, in step (550) the microprocessor (213) compares the target "inlet speed," $RPM_S$ to the target "outlet speed," $RPM_d$, and selects the lesser of the two. Then, in step (552) the microprocessor determines the voltage value that corresponds to the selected speed through a computation using the calibration of output voltage to drive mechanism speed that was performed in the last two steps (513 and 515) of the initialization.

With the control logic just described, the microprocessor is set up to attempt to ensure that the inlet pressure stays below the preferred maximum and the outlet pressure stays above the preferred minimum. There is only one pump, however, and so only one pump speed can be selected by the microprocessor (213). A selection must be made as between the target "inlet speed" and the target "outlet speed." By selecting the lesser of the two target speeds in step (550), this embodiment of the control logic strikes a compromise. The compromise can be described as selecting the speed that will keep the inlet pressure as low as is reasonable relative to the outlet pressure, while keeping the outlet pressure as high as is reasonable relative to the inlet pressure. This choice recognizes the direct link between inlet and outlet pressure, and is made knowing that because of the external factors (fluid flow system parameters) both pressures cannot necessarily be kept within specified ranges.

The particular compromise that is embodied in the control logic is a design choice to be made by the designer of a particular embodiment of the pressure controller (205). In an embodiment of the control logic, a compromise may be struck that selects the speed that will keep the inlet pressure as high as is reasonable relative to the outlet pressure, while keeping the outlet pressure as low as is reasonable relative to the inlet pressure. Knowing of the direct relationship between the inlet and outlet pressures allows a control logic designer to strike a compromise that is appropriate for a given application. In additional alternate embodiments of the control logic boundary points other than those used in the control logic of FIG. 4 may be used as the primary references for comparison and selection of target "inlet" and "outlet" speeds. For example, the boundary points used as comparators to the measured pressure values may be an inlet pressure minimum limit and an outlet pressure maximum limit.

Embodiments of the control logic generally separately compare pressure measurements at the inlet and outlet of a pump to certain pre-selected values. The pre-selected values are generally chosen from among the end points of the separate, preferred pressure ranges at the inlet and outlet, which preferred pressure range values may change from application to application. The pre-selected values could be almost any value depending on the ability of the fluid flow system to handle the desired pressure.

Embodiments of the control logic also generally utilize calibration curves to calculate a possible value for the target pump speed for either the inlet or the outlet. While the relationships for pump speed to pressure (inlet or outlet) have been described in the embodiment of FIG. 4 as linear, other mathematical relationships may be used for these relationships, and may better describe the relationship between pump speed and inlet or outlet pressure in some circumstances. For instance, higher than first order equations could be used, as well as could be exponential or differential equations. Even if other mathematical relationships were the basis for determining the desired drive mechanism (201) speed, the logic could work on the same principles set forth above. With the use of other mathematical relationships, the initialization steps may need to change so as to determine more than the two constants needed for the equation of a line, i.e., slope and intercept. The operating steps (560) would only require the substitution of the alternate relationship of pressure to pump speed for the linear relationship used in steps (532 and 542).

Given these general concepts of calibration curves used to define the relationship of target pump speed to fluid pressure, and externally set pressure limits used for comparison, one of ordinary skill in the art can understand that multiple alternative control logic schemes could be developed that may use additional steps or fewer steps and would be included within the scope of this invention.

Additionally, drive mechanism speed values have been referred to in some portions of this description as a maximum speed, $RPM_{max}$, and a minimum speed, $RPM_{idle}$. While these speeds may correlate respectively to the maximum safe continuous operating speed set by the drive mechanism manufacturer, and to the idle speed of the drive mechanism, these maximum and minimum speed values may be specifically set at other so-called minimum and maximum values within the whole range of allowable drive mechanism speeds.

In further alternate embodiments of a pressure controller of this invention a pressure controller could also include enhancing features such as pump maintenance analysis and fluid flow system analysis. Pump maintenance analysis capability may be both diagnostic and prognostic. That is, the microprocessor control logic may include steps that compare pump operations, as monitored through the inlet and outlet pressures, or through other pump parameters to determine if and when pump maintenance may need to be done. Fluid flow monitoring may be calculated using the known speed of the pump drive mechanism and the volume pumped per revolution of the drive mechanism, or may be monitored using an additional flow meter. Flow monitoring may be important particularly for the detection of fluid leaks in the fluid flow system. Early detection of pump or flow problems leads to enhanced efficiency of pumping by allowing for earlier intervention if necessary.

An additional enhancement made easier by embodiments of the invention is the networking of (providing communications links between) the pressure controllers on multiple pumps, an enhancement that may be particularly beneficial for pumps along a daisy chain. Where pressure controllers along a daisy chain are networked, the communication of pressure data from one pressure controller to another, especially the next pressure controller in the series, can provide a great benefit to the maintenance of steady fluid flow. In the case of networked pressure controllers, the control logic could take account of the pressure data from other pumps to provide a more even pressure at the inlet and outlet of each of the pumps. Communication through networking of pressure controllers may also generally aid in monitoring performance of the entire fluid flow system, including the ability to detect and adjust for fluid leaks in the system.

While the invention has been disclosed in connection with certain preferred embodiments, such disclosure is not intended and should not be construed so as to limit the invention to only those elements and relationships described, nor to all of the elements and relationships described. Modifications and variations of the described embodiments may be made without departing from the spirit and scope of the invention, and other embodiments should be understood to be encompassed in the present disclosure as would be understood by those of ordinary skill in the art.

The invention claimed is:

1. A pressure controller for use with a pump through which a fluid can pass and which can be driven at a selected speed by a pump drive mechanism, said pressure controller comprising, a microprocessor having a control logic program configured to receive at least two electrical signals correlated to at least two pressure values, said electrical signals being generated by at least one pressure transducer configured to transduce the pressure values of the fluid entering and exiting said pump;

wherein, said microprocessor produces an output electrical signal used by said pump drive mechanism to drive said pump at said selected speed based on said control logic program, and wherein said microprocessor uses at least one of a first drive mechanism speed effective to control the pressure entering the pump, and a second drive mechanism speed effective to control the pressure exiting the pump to determine a pump drive mechanism speed that would theoretically maintain at least one of said pressure entering said pump and said pressure exiting said pump at about the value at which said pressures entering and exiting said pump were measured via said electrical signals.

2. A pressure controller of claim 1, wherein said microprocessor computes the specific weight of the fluid being pumped from measured values of the pressures entering and exiting the pump during pumping, and uses the computed specific weight to select the first and second known drive mechanism speeds.

* * * * *